US005957008A

United States Patent [19]

Long

[11] Patent Number: 5,957,008

[45] Date of Patent: Sep. 28, 1999

[54] ADJUSTABLE RATCHET WRENCH

[76] Inventor: Paul S. Long, 720 Porter St., Bridgewater, Pa. 15009

[21] Appl. No.: 09/070,571

[22] Filed: Apr. 30, 1998

[51] Int. Cl.[6] ..... B25B 13/46

[52] U.S. Cl. ..... 81/63; 81/177.2

[58] Field of Search ..... 81/61–63, 177.2, 81/177.85, 177.1

[56] References Cited

U.S. PATENT DOCUMENTS 2,634,630 4/1953 Johnson ..... 81/62 X 4,274,311 6/1981 Ebert ..... 81/63

*Primary Examiner*—D. S. Meislin

[57] ABSTRACT

A new adjustable ratchet wrench for including forward, reverse and neutral operative positions. The inventive device includes a ratchet head assembly. An upper handle portion is secured to and extends downwardly from the ratchet head assembly. The upper handle portion has a hollow interior. The hollow interior has a neutral set bar slidably positioned therein. The neutral set bar has a generally U-shaped configuration with upper free ends extending inwardly of the ratchet head assembly. The upper free ends are angled outwardly for selectively abutting internal components of the ratchet head assembly. The neutral set bar has a spring positioned between the free ends thereof. An upper push rod extends downwardly from the neutral set bar. A lower end of the upper push rod extends outwardly of an open lower end of the upper handle portion.

6 Claims, 2 Drawing Sheets

ADJUSTABLE RATCHET WRENCH

BACKGROUND OF THE INVENTION

1. Field of the Invention

The present invention relates to wrenches and more particularly pertains to a new adjustable ratchet wrench for including forward, reverse and neutral operative positions.

2. Description of the Prior Art

The use of wrenches is known in the prior art. More specifically, wrenches heretofore devised and utilized are known to consist basically of familiar, expected and obvious structural configurations, notwithstanding the myriad of designs encompassed by the crowded prior art which have been developed for the fulfillment of countless objectives and requirements.

Known prior art wrenches include U. S. Pat. No. 4,586,406 to Howard; U.S. Pat. No. 4,581,958 to Shull; U.S. Pat. No. 4,376,397 to Newby et al.; U.S. Pat. No. 4,367,663 to Merics; U.S. Pat. No. 4,070,932 to Jeannotte; and U.S. Pat. No. Des. 329,970 to Lee.

While these devices fulfill their respective, particular objectives and requirements, the aforementioned patents do not disclose a new adjustable ratchet wrench. The inventive device includes a ratchet head assembly. An upper handle portion is secured to and extends downwardly from the ratchet head assembly. The upper handle portion has a hollow interior. The hollow interior has a neutral set bar slidably positioned therein. The neutral set bar has a generally U-shaped configuration with upper free ends extending inwardly of the ratchet head assembly. The upper free ends are angled outwardly for selectively abutting internal components of the ratchet head assembly. The neutral se t bar has a spring positioned between the free ends thereof. An upper push rod extends downwardly from the neutral set bar. A lower end of the upper push rod extends outwardly of an open lower end of the upper handle portion.

In these respects, the adjustable ratchet wrench according to the present invention substantially departs from the conventional concepts and designs of the prior art, and in so doing provides an apparatus primarily developed for the purpose of including forward, reverse and neutral operative positions.

SUMMARY OF THE INVENTION

In view of the foregoing disadvantages inherent in the known types of wrenches now present in the prior art, the present invention provides a new adjustable ratchet wrench construction wherein the same can be utilized for including forward, reverse and neutral operative positions.

The general purpose of the present invention, which will be described subsequently in greater detail, is to provide a new adjustable ratchet wrench apparatus and method which has many of the advantages of the wrenches mentioned heretofore and many novel features that result in a new adjustable ratchet wrench which is not anticipated, rendered obvious, suggested, or even implied by any of the prior art wrenches, either alone or in any combination thereof.

To attain this, the present invention generally comprises a ratchet head assembly having a housing with a circular upper portion and a tapered lower portion. The ratchet head assembly includes a square socket drive rotatably coupled with the circular upper portion. The socket drive has an inner end extending interiorly of the circular upper portion. A ratchet gear is disposed interiorly of the circular upper portion. The ratchet gear is secured to the inner end of the socket drive. A directional cam is pivotally disposed within the tapered lower portion. The directional cam includes a central pivoting section and a pair of outer teeth portions. The outer teeth portions are adapted for engaging the ratchet gear. The central pivoting section includes a lower balancing tooth extending downwardly towards an open lower end of the tapered lower portion. A stop bar is disposed within the open lower end. An upper handle portion is secured to and extends downwardly from the housing of the ratchet head assembly. The upper handle portion has an open upper end secured to the open lower end of the tapered lower portion. The upper handle portion has a hollow interior. The hollow interior has a neutral set bar slidably positioned therein. The neutral set bar has a generally U-shaped configuration with upper free ends extending inwardly of the open lower end of the tapered lower portion. The upper free ends are angled outwardly for selectively abutting lower portions of the outer teeth portions of the directional cam. The neutral set bar has a spring positioned between the free ends thereof. An upper end of the spring is in contact with the stop bar. An upper push rod extends downwardly from the neutral set bar. A lower end of the upper push rod extends outwardly of an open lower end of the upper handle portion. An intermediate connector portion is removably secured to the open lower end of the upper handle portion. The intermediate connector portion has a hollow interior. The intermediate connector portion receives the lower end of the upper push rod within an open upper end thereof. An internal coupler is secured to the lower end of the upper push rod. The intermediate connector portion has a threaded extension extending downwardly therefrom. A lower handle portion is provided having an open upper end removably coupled with the threaded extension of the intermediate connector portion. The lower handle portion has a lower push rod slidably disposed therein. An upper end of the lower push rod extends outwardly of the open upper end for coupling with the internal coupler. A lower end of the lower push rod extends outwardly of an open threaded lower end of the lower handle portion. A push button is provided and is disposed within a cylindrical housing. An open upper end of the cylindrical housing couples with the open threaded lower end of the lower handle portion. The push button couples with the lower end of the lower push rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they (to not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable ratchet wrench apparatus and method which has many of the advantages of the wrenches mentioned heretofore and many novel features that result in a new adjustable ratchet wrench which is not anticipated, rendered obvious, suggested, or even implied by any of the prior art wrenches, either alone or in any combination thereof.

It is another object of the present invention to provide a new adjustable ratchet wrench which may be easily and efficiently manufactured and marketed.

It is a further object of the present invention to provide a new adjustable ratchet wrench which is of a durable and reliable construction.

An even further object of the present invention is to provide a new adjustable ratchet wrench which is susceptible of a low cost of manufacture with regard to both materials and labor, and which accordingly is then susceptible of low prices of sale to the consuming public, thereby making such adjustable ratchet wrench economically available to the buying public.

Still yet another object of the present invention is to provide a new adjustable ratchet wrench which provides in the apparatuses and methods of the prior art some of the advantages thereof, while simultaneously overcoming some of the disadvantages normally associated therewith.

Still another object of the present invention is to provide a new adjustable ratchet wrench for including forward, reverse and neutral operative positions.

Yet another object of the present invention is to provide a new adjustable ratchet wrench which includes a ratchet head assembly. An upper handle portion is secured to and extends downwardly from the ratchet head assembly. The upper handle portion has a hollow interior. The hollow interior has a neutral set bar slidably positioned therein. The neutral set bar has a generally ULJ-shaped configuration with upper free ends extending inwardly of the ratchet head assembly. The upper free ends are angled outwardly for selectively abutting internal components of the ratchet head assembly. The neutral set bar has a spring positioned between the free ends thereof. An upper push rod extends downwardly from the neutral set bar. A lower end of the upper push rod extends outwardly of an open lower end of the upper handle portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
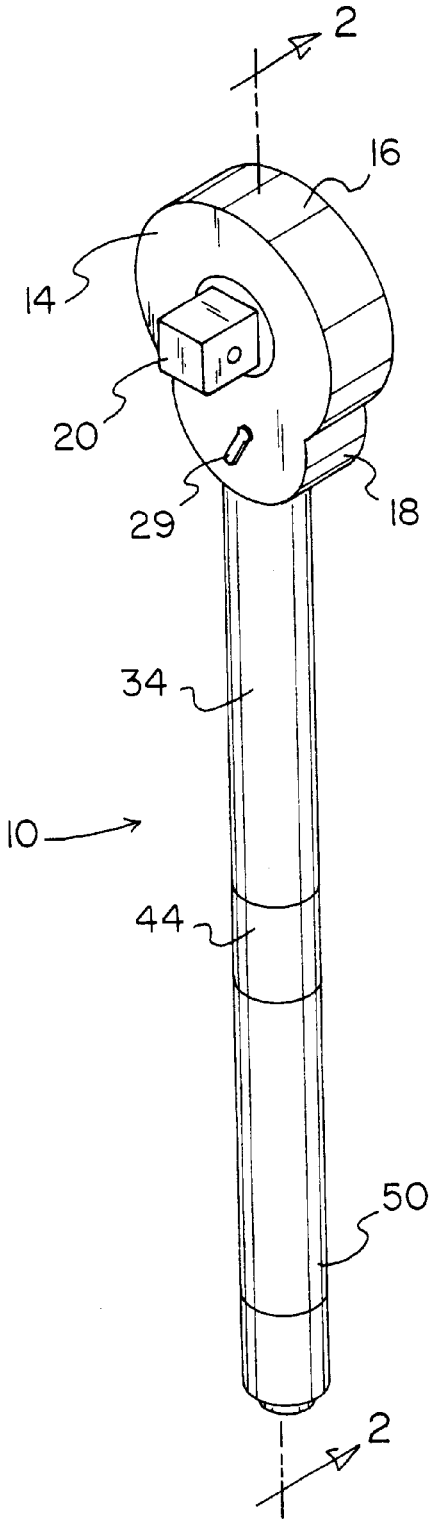
FIG. 1 is a perspective view of a new adjustable ratchet wrench according to the present invention.
Figure 2:
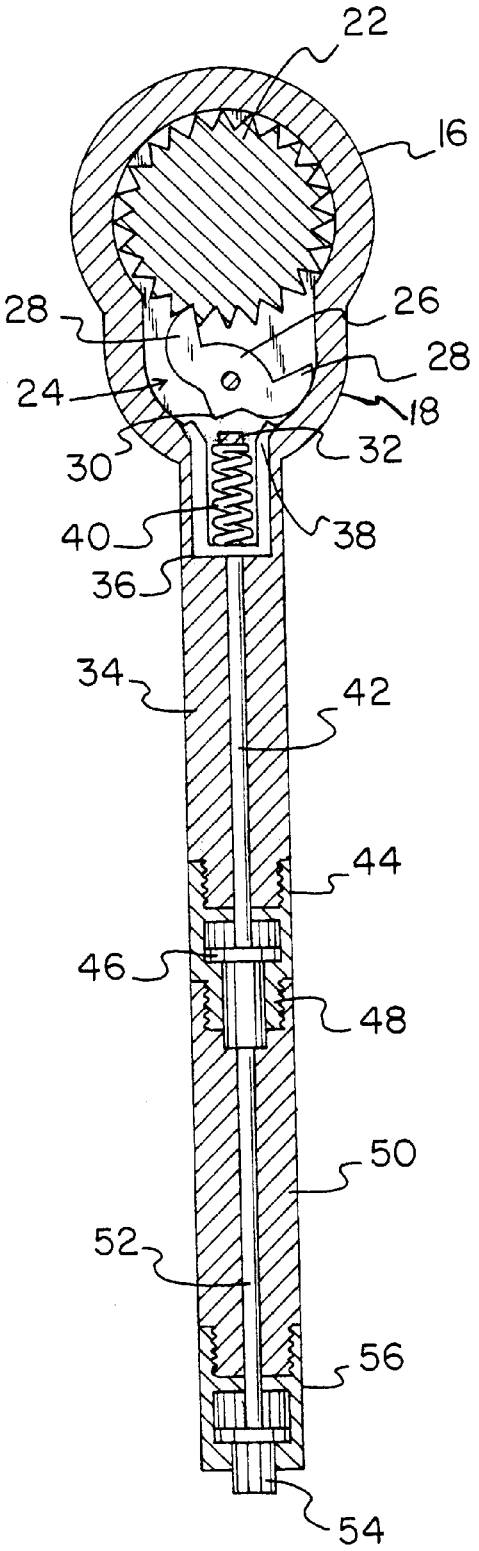
FIG. 2 is a cross-sectional view of the present invention as taken along line 2—2 of FIG. 1.
Figure 3:
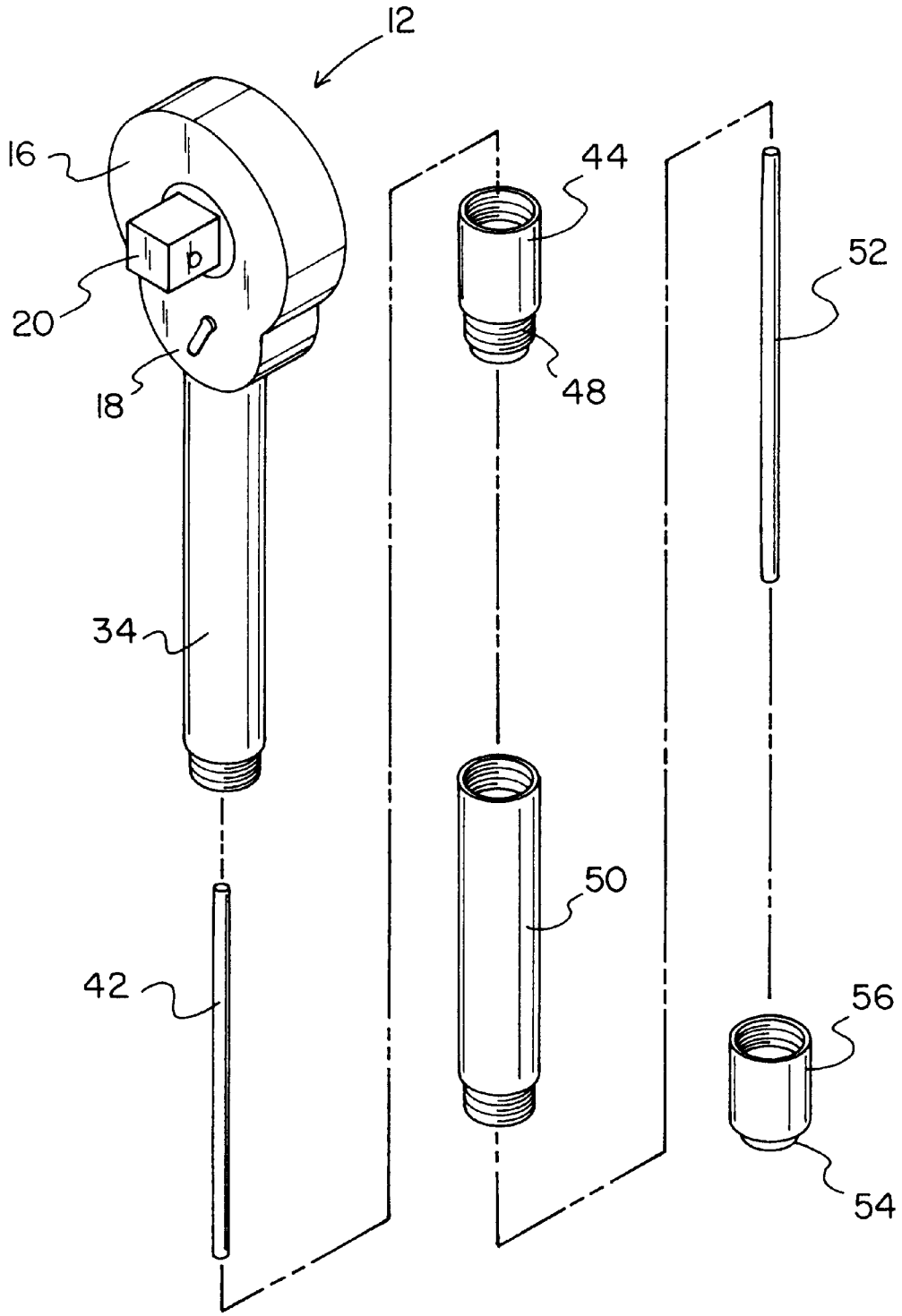
FIG. 3 is an exploded perspective view of the present invention.

With reference now to the drawings, and in particular to FIGS. 1 through 3 thereof, a new adjustable ratchet wrench embodying the principles and concepts of the present invention and generally designated by the reference numeral 10 will be described.

As best illustrated in FIGS. 1 through 3, the adjustable ratchet wrench 10 comprises a ratchet head assembly 12 having a housing 14 with a circular upper portion 16 and a tapered lower portion 18. The ratchet head assembly 12 includes a square socket drive 20 rotatably coupled with the circular upper portion 16. The socket drive 20 has an inner end extending interiorly of the circular upper portion 16. A ratchet gear 22 is disposed interiorly of the circular upper portion 16. The ratchet gear 22 is secured to the inner end of the socket drive 20. A directional cam 24 is pivotally disposed within the tapered lower portion 18. The directional cam 24 includes a central pivoting section 26 and a pair of outer teeth portions 28. The outer teeth portions 28 are adapted for engaging the ratchet gear 22. An adjustment switch 29 is disposed exteriorly of the tapered lower portion. The adjustment switch 29 is coupled with the directional cam 24 for selectively engaging either of the outer teeth portions 28 with the ratchet gear 22. By moving the adjustment switch 29 in either direction, the user can use the device 10 for tightening or loosening functions. The central pivoting section 26 includes a lower balancing tooth 30 extending downwardly towards an open lower end of the tapered lower portion 18. A stop bar 32 is disposed within the open lower end.

An upper handle portion 34 is secured to and extends downwardly from the housing 14 of the ratchet head assembly 12. The upper handle portion 34 has an open upper end secured to the open lower end of the tapered lower portion 18. The upper handle portion 34 has a hollow interior. The hollow interior has a neutral set bar 36 slidably positioned therein. The neutral set bar 36 has a generally U-shaped configuration with upper free ends 38 extending inwardly of the open lower end of the tapered lower portion 18. The upper free ends 38 are angled outwardly for selectively abutting lower portions of the outer teeth portions 28 of the directional cam 24. The neutral set bar 36 has a spring 40 positioned between the free ends thereof. An upper end of the spring 40 is in contact with the stop bar 32. An upper push rod 42 extends downwardly from the neutral set bar 36. A lower end of the upper push rod 42 extends outwardly of an open lower end of the upper handle portion 34.

An intermediate connector portion 44 is removably secured to the open lower end of the upper handle portion 34. The intermediate connector portion 44 has a hollow interior. The intermediate connector portion 44 receives the lower end of the upper push rod 42 within an open upper end thereof. An internal coupler 46 is secured to the lower end of the upper push rod 42. The intermediate connector portion 44 has a threaded extension 48 extending downwardly therefrom.

A lower handle portion 50 is provided having an open upper end removably coupled with the threaded extension 48 of the intermediate connector portion 44. The lower handle portion 50 has a lower push rod 52 slidably disposed therein. An upper end of the lower push rod 52 extends outwardly of the open upper end for coupling with the internal coupler 46. A lower end of the lower push rod 52 extends outwardly of an open threaded lower end of the lower handle portion 50.

A push button 54 is provided and is disposed within a cylindrical housing 56. An open upper end of the cylindrical housing 56 couples with the open threaded lower end of the lower handle portion 50. The push button 54 couples with the lower end of the lower push rod 52.

In use, either of the outer teeth portions 28 will be engaged to the ratchet gear 22 for use in tightening and loosening functions. By pressing inwardly on the push button 54, the upper and lower push rods 42,52 will move upwardly thereby forcing the neutral set bar 36 upwardly to abut the directional cam 24. The directional cam 24 will then be centered allowing for the free rotation of the ratchet gear 22. The spring 40 will bias the rods 42,52 and the neutral set bar 36 downwardly when the push button is released.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new adjustable ratchet wrench for including forward, reverse and neutral operative positions comprising, in combination:

a ratchet head assembly having a housing with a circular upper portion and a tapered lower portion, the ratchet head assembly including a square socket drive rotatably coupled with the circular upper portion, the socket drive having an inner end extending interiorly of the circular upper portion, a ratchet gear disposed interiorly of the circular upper portion, the ratchet gear secured to the inner end of the socket drive, a directional cam pivotally disposed within the tapered lower portion, the directional cam including a central pivoting section and a pair of outer teeth portions, the outer teeth portions being adapted for engaging the ratchet gear, the central pivoting section including a lower balancing tooth extending downwardly towards an open lower end of the tapered lower portion, a stop bar disposed within the open lower end;

an upper handle portion secured to and extending downwardly from the housing of the ratchet head assembly, the upper handle portion having an open upper end secured to the open lower end of the tapered lower portion, the upper handle portion having a hollow interior, the hollow interior having a neutral set bar slidably portioned therein, the neutral set bar having a generally configuration with upper free ends extending inwardly of the open lower end of the tapered lower portion, the upper free ends being angled outwardly for selectively abutting lower portions of the outer teeth portions of the directional cam, the neutral set bar having a spring positioned between the free ends thereof, an upper end of the spring being in contact with the stop bar, an upper push rod extending downwardly from the neutral set bar, a lower end of the upper push rod extending outwardly of an open lower end of the upper handle portion;

an intermediate connector portion removably secured to the open lower end of the upper handle portion, the intermediate connector portion having a hollow interior, the intermediate connector portion receiving the lower end of the upper push rod within an open upper end thereof, an internal coupler secured to the lower end of the upper push rod, the intermediate connector portion having a threaded extension extending downwardly therefrom;

a lower handle portion having an open upper end removably coupled with the threaded extension of the intermediate connector portion, the lower handle portion having a lower push rod slidably disposed therein, an upper end of the lower push rod extending outwardly of the open upper end for coupling with the internal coupler, a lower end of the lower push rod extending outwardly of an open threaded lower end of the lower handle portion;

a push button disposed within a cylindrical housing, an open upper end of the cylindrical housing coupling with the open threaded lower end of the lower handle portion, the push button coupling with the lower end of the lower push rod.

2. A new adjustable ratchet wrench for including forward, reverse and neutral operative positions comprising, in combination:

a ratchet head assembly;

an upper handle portion secured to and extending downwardly from the ratchet head assembly, the upper handle portion having a hollow interior, the hollow interior having a neutral set bar slidably portioned therein, the neutral set bar having a generally U-shaped configuration with upper free ends extending inwardly of the ratchet head assembly, the upper free ends being angled outwardly for selectively abutting internal components of the ratchet head assembly, the neutral set bar having a spring positioned between the free ends thereof, an upper push rod extending downwardly from the neutral set bar, a lower end of the upper push rod extending outwardly of an open lower end of the upper handle portion.

3. The adjustable ratchet wrench as set forth in claim 2 and further including an intermediate connector portion removably secured to the open lower end of the upper handle portion, the intermediate connector portion having a hollow interior, the intermediate connector portion receiving the lower end of the upper push rod within an open upper end thereof, an internal coupler secured to the lower end of the upper push rod, the intermediate connector portion having a threaded extension extending downwardly therefrom.

4. The adjustable ratchet wrench as set forth in claim 3 and further including a lower handle portion having an open upper end removably coupled with the threaded extension of the intermediate connector portion, the lower handle portion having a lower push rod slidably disposed therein, an upper end of the lower push rod extending outwardly of the open upper end for coupling with the internal coupler, a lower end of the lower push rod extending outwardly of an open threaded lower end of the lower handle portion.

5. The adjustable ratchet wrench as set forth in claim 4 and further including a push button disposed within a cylindrical housing, an open upper end of the cylindrical housing coupling with the open threaded lower end of the lower handle portion, the push button coupling with the lower end of the lower push rod.

6. The adjustable ratchet wrench as set forth in claim 2 wherein the ratchet head assembly has a housing with a circular upper portion and a tapered lower portion, the ratchet head assembly including a square socket drive rotatably coupled with the circular upper portion, the socket drive having an inner end extending interiorly of the circular upper portion, a ratchet gear disposed interiorly of the circular upper portion, the ratchet gear secured to the inner end of the socket drive, a directional cam pivotally disposed within the tapered lower portion, the directional cam including a central pivoting section and a pair of outer teeth portions, the outer teeth portions being adapted for engaging the ratchet gear, the central pivoting section including a lower balancing tooth extending downwardly towards an open lower end of the tapered lower portion, a stop bar disposed within the open lower end.

* * * * *